United States Patent [19]

Kasai et al.

[11] Patent Number: 4,791,452

[45] Date of Patent: Dec. 13, 1988

[54] IMAGE FORMING APPARATUS HAVING AT LEAST TWO-COLOR IMAGE PRINT FUNCTION AND METHOD FOR CONTROLLING THE SAME

[75] Inventors: Toshihiro Kasai; Tatsuya Tsujii, both of Yokohama, Japan

[73] Assignee: Kabushiki Kaisha Toshiba, Kawasaki, Japan

[21] Appl. No.: 110,862

[22] Filed: Oct. 21, 1987

[30] Foreign Application Priority Data

Oct. 28, 1986 [JP] Japan ..... 61-254713

[51] Int. Cl.[4] ..... G03G 15/00

[52] U.S. Cl. ..... 355/14 D; 355/3 DD; 355/3 R

[58] Field of Search ..... 355/3 R, 14 R, 24, 25, 355/26, 23, 5, 3 DD, 14 D

[56] References Cited

U.S. PATENT DOCUMENTS

| | | | |
|---|---|---|---|
| 3,936,171 | 2/1976 | Brooke | 355/26 X |
| 4,294,534 | 10/1981 | Snelling | 355/3 R |
| 4,552,449 | 11/1985 | Wakamatsu et al. | 355/3 R |
| 4,572,651 | 2/1986 | Komatsu et al. | 355/3 DD X |
| 4,705,394 | 11/1987 | Watanabe | 355/3 DD |

OTHER PUBLICATIONS

*Nikkei Electronics*, pp. 123–132, issued Oct. 6, 1986 "Two Color Laser Printer Which is Looking About the Timing of Sale".

*Primary Examiner*—A. C. Prescott

*Attorney, Agent, or Firm*—Foley & Lardner, Schwartz, Jeffery, Schwaab, Mack, Blumenthal & Evans

[57] ABSTRACT

Single-colored image printing and multi-colored image printing are carried out by an image forming apparatus in response to color signals. The image forming apparatus includes an image carrier, a first image forming unit having a first developer wherein a first color developing agent is stored, and a second image forming unit having a second developer wherein a second color developing agent is stored.

A single color image is formed on the image carrier when only a first color signal is received by the apparatus in the single-colored image printing. When a single-colored image printing is carried out by the first developer, a prescribed bias voltage is applied to the second developer to prevent the second color developing agent from the contamination by the first color developing agent of the single color image formed on the image carrier.

16 Claims, 5 Drawing Sheets

IMAGE FORMING APPARATUS HAVING AT LEAST TWO-COLOR IMAGE PRINT FUNCTION AND METHOD FOR CONTROLLING THE SAME

BACKGROUND OF THE INVENTION

1. Field of the Invention

The present invention relates, in general, to image forming apparatus. In particular the invention relates to an electrophotographic image forming apparatus wherein at least two-color images are formed on a photosensitive drum acting as an image carrier when the drum makes a single turn.

2. Description of the Prior Art

In image forming apparatus in which a plurality of color images are formed on an image carrier byusing a plurality of color developing agents digitized image data are converted into light image data by a light-emitting element or a photo-switching element. The light image data are formed on the image carrier as an electrostatic latent image. A laser diode and a light-emitting diode are used as the light-emitting element. A liquid crystal and an element using the Faraday effect are used as the photo-switching element. In this type of image forming apparatus, each color of a document image is designated by an operator. The latent image corresponding to the document image is developed by each color developing agent in accordance with the designated color data of the document image.

FIG. 1 shows one example of the image forming apparatus described above in FIG. 1, a photosensitive drum 21 rotates clockwise. The surface of photosensitive drum 21 is coharged at a prescribed surface voltage level by a first charger 23. A first electrostatic latent image is formed on drum 21 by a laser beam 25, which scans the surface of drum 21 in response to image data from a host system. The first latent image on drum 21 is developed by a first developer 27 in which a first color developing agent 27*a* is stored. Following the first color developing Operation, the surface of drum 21 carrying the developed first color image is recharged to a prescribed surface voltage level by a second charger 29. A second electrostatic latent image then is formed on drum 21 by a laser beam 31. The second latent image on drum 21 is developed by a second developer 33, in which a second color developing agent 33*a*, different from the first color developing agent 27*a*, is stored. At this time, the first color developing agent and the second color developing agent are present on the same surface of drum 21. The first color developing agent and the second color developing agent are transferred onto a sheet 35 in a visible image by a transfer charger 37 as sheet 35 is conveyed in the direction indicated by arrow A. Before the transfer process described above, the charged polarity and the charged quantity between the first developing agent and the second developing agent on drum 21 are equalized by a pre-transfer charger (not shown), if necessary. After the transfer process described above, the residual first and second color developing agents are removed by a cleaner 39, and the latent images are erased by a discharge lamp 41. Thus, the printing process is completed, and the image forming apparatus stands by for the next print operation.

A similar construction of two color image laser printer is disclosed in Nikkei Electronics, pages 123 to 132, issued on Oct. 6, 1986.

It is believed that the above-described type of image forming apparatus has not been used previously for making single color prints using one of the plurality of color developing agents. One reason may be that the second or subsequent color developing agents can become contaminated when only a single color image is developed, but multiple chargings and biasing controls are necessary, as discoverd by the present inventors.

SUMMARY OF THE INVENTION

It is an object of the present invention to attain a clear single color print by an image forming apparatus which has at least a two-color image print function.

It is another object of the present invention to avoid the contamination of a color developing agent which would occur if a single color image print was carried out by an image forming apparatus having at least a two-color image print function.

It is still another object of the invention to provide a method for forming a single color image by an image forming apparatus having at least a two-color image print function.

To accomplish the above objects, there is provided an image forming apparatus wherein single and multicolored images are formed on an image carrier in response to color images. The image forming apparatus includes a first image forming unit responsive to a first color image signal having a first developer for forming a first color image on the image carrier, and a second image forming unit responsive to a second image signal having a second developer for forming a second color image on the image carrier. The second image forming unit includes a recharging device for recharging the image carrier after first color image is formed. The image forming apparatus further includes a control unit for applying a bias voltage to the second developer for reducing the difference in potential level between the first color image and the second developer when only the first color image signal is received by the apparatus.

BRIEF DESCRIPTION OF THE DRAWINGS

The present invention is best understood with reference to accompanying drawings in which.

DETAILED DESCRIPTION OF THE PREFERRED EMBODIMENT

Referring to the accompanying drawings, one embodiment of the present invention will be described.

Figure 1:
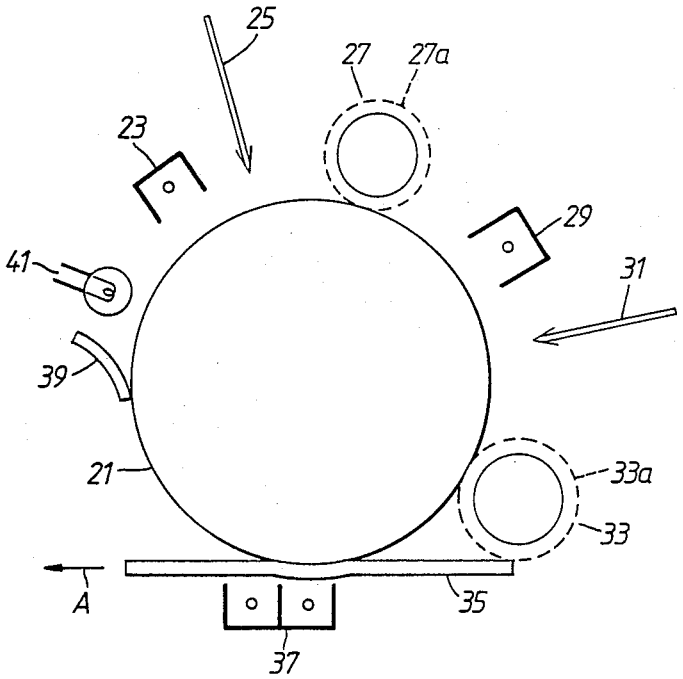
FIG. 1. PRIOR ART
FIG. 1 is a schematic view illustrating the arrangement of an image forming section of a conventional image forming apparatus.
Figure 2:
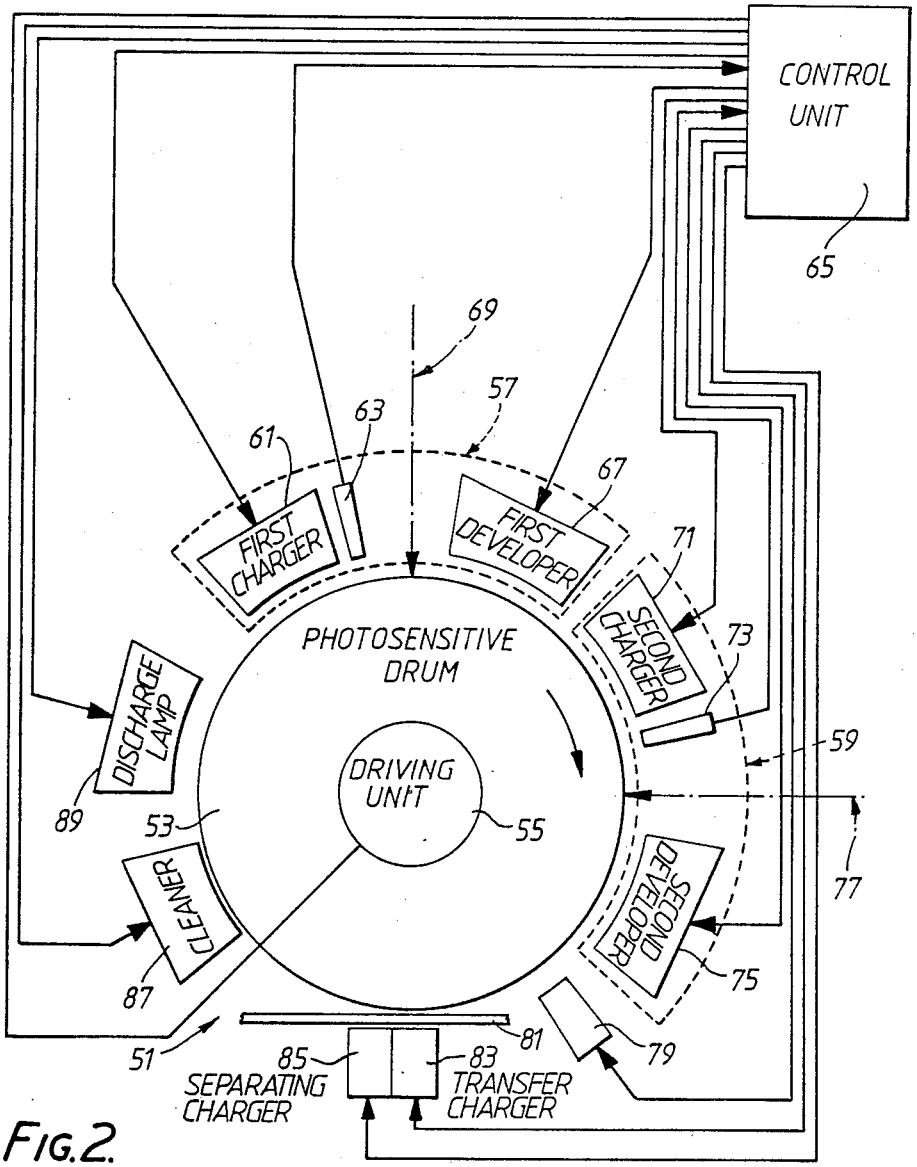
FIG. 2 is a block diagram illustrating the arrangement of an image forming section of an image forming apparatus of one embodiment of the present invention.

FIG. 2 is a block diagram illustrating a two-color image laser beam printer (hereinafter referred to a two-color image LBP) of one embodiment of the present invention. In the two-color image LBP, a control unit is connected to a host system, such as, e.g., a computer, a word processing machine, etc. The control unit receives first image data for a first color print and second image data for a second color print serially fed from the host system, and a first laser beam and a second laser beam, used as an illuminating element, are individually modulated in accordance with the corresponding first and second image data. A first electrostatic latent image is formed on a photosensitive drum by the first laser beam, and is developed into a first color image by a first developer, in which a first color developing agent is stored. Following the first color development, a second electrostatic latent image is formed on the drum by the second laser beam, and is developed into a second color image by a second developer, in which a second color developing agent different to the first color developing agent is stored. Then, the first and second color images respectively developed by the first and the second color developing agents are transferred onto a printing sheet, as a visible image. The above-described image forming operation is completed when the drum makes a single turn.

As can be seen in FIG. 2, to attain the above-described operation, a two-color image LBP 51 is provided with a photosensitive drum 53. Photosensitive drum 63 is rotated clockwise by a driving unit 55. First and second image formation units 57 and 59 are arranged in succession around drum 53. First image formation unit 57 includes a first charger 61 composed of a corotron charging device for charging the surface of drum 53 to a prescribed level, and a first electrical potential sensor 63 for detecting the surface potential level of drum 53 and determining whether the charged potential level of drum 53 is the prescribed potential level or not. If the surface potential level of drum 6S detected by sensor 63 is not the prescribed surface potential level the charging surface potential of first charger 61 is regulated by a control unit 65 in accordance with the detection result of sensor 63. First image formation unit 57 further includes a first developer 67 in which a first color developing agent is stored. After the charging process described above is completed, a first electrostatic latent image is created on drum 53 by a first laser beam 69 in response to the image data from the host system (not shown), and is developed by first developer 67. Thus, a first color image is formed on drum 53.

Second image formation unit 59 includes a second charger 71 composed of the scorotron charging device for recharging the surface of drum 53 on which the first color image exists. Second image formation unit 59 further includes a second electrical potential sensor 73 for detecting the surface potential level of drum 53. If the surface potential level of drum 53 detected by sensor 73 does not reach a prescribed surface potential level, the charging surface potential of second charger 71 is controlled by control unit 65 in accordance with the detection result of sensor 73. Second image formation unit 59 includes a second developer 75 in which a second color developing agent is stored. The surface of drum 53 is illuminated by a second laser beam 77 in response to the image data fed from the host system, and thereby a second electrostatic latent image is created on drum 53. Then, the second electrostatic latent image is developed by second developer 75. Immediately after the second developing process described above, electric charge quantities of the first and the second developed images are equalized by a pretransfer charger 79. This is because only the first developed image on drum 53 is recharged by second charger 71, as described above. The first and the second developed images are transferred to a sheet 81 by a transfer charger 83, and sheet 81 is stripped from drum 53 by a separating charger 85. After the transfer process described above, the residual first and second color developing agents are removed by a cleaner 87, and the latent images are erased by a discharge lamp 89.

Figure 3:
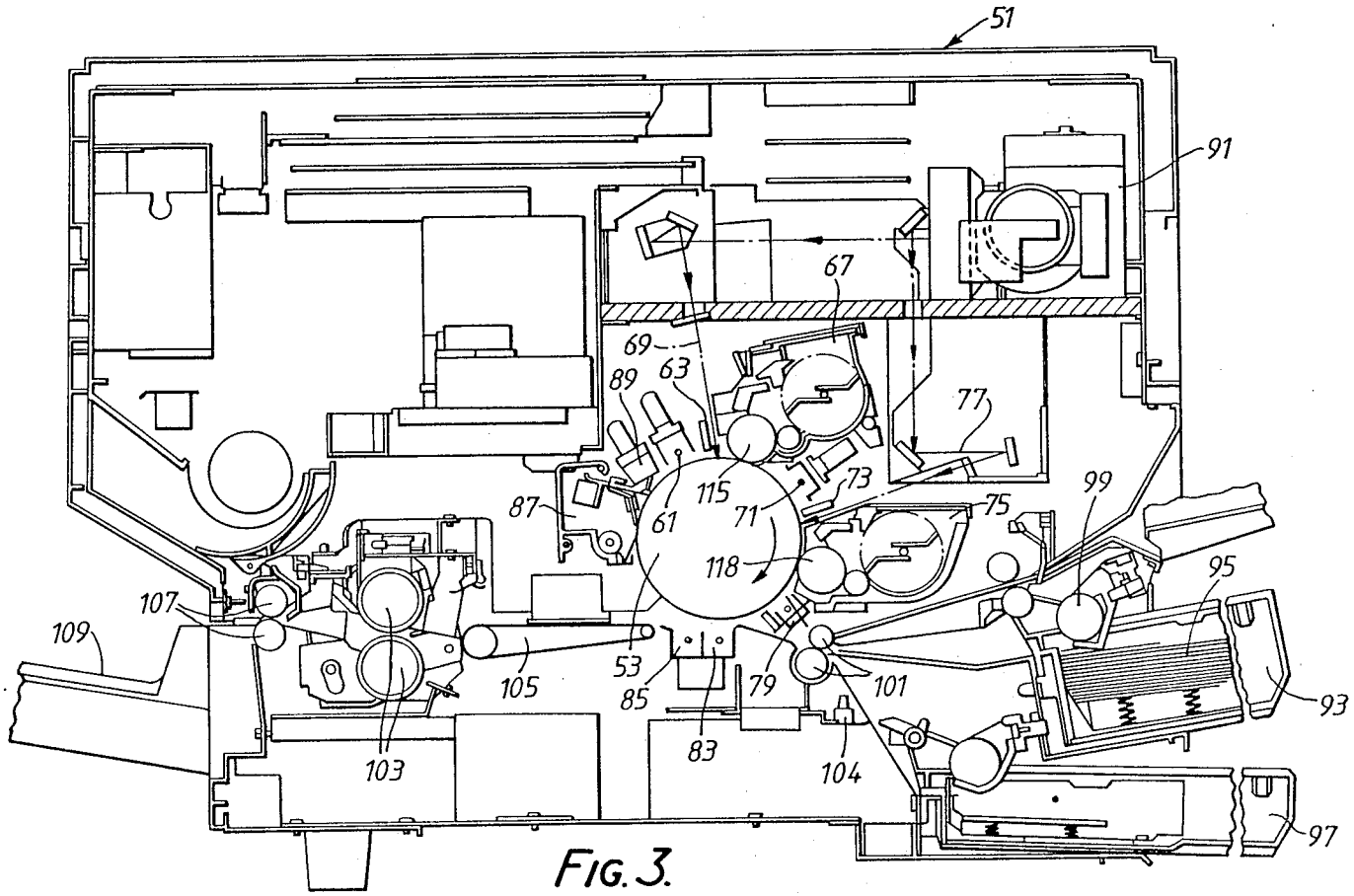
FIG. 3 is a cross sectional side view illustrating the overall configuration of the image forming apparatus of one embodiment.

FIG. 3 is a sectional side view illustrating the construction of the two-color image LBP of one embodiment. In FIG. 3, same numerals are applied to the elements similar to that of FIG. 2, and therefore the detailed descriptions thereof are omitted.

As can be seen in FIG. 3, two-color image LBP is provided with a conventional polygon-scanning unit 91 wherein two laser diodes (not shown) acting as an image formation element are provided to individualy generate first and second laser beams 69 and 77. Polygon-scanning unit 91 includes a polygonal mirror (not shown to reflect one of first and second laser beams 69 and 77 toward drum 53. The surface of drum 53 is illuminated by one of first and second laser beams 69 and 77 as the polygonal mirror of polygon-scanning unit 91 rotates. An upper paper cassette 93, wherein recording sheets 95 are stacked, is inserted into a lower portion of LBP 51. A lower paper cassette 97 also is inserted into lower portion of LBP 51. The upper-most sheet 95 in upper paper cassette 93 is taken out one by one by a paper-feed roller 99. Sheet 95 is fed to a pair of aligning rollers 101. At this time, aligning rollers pair 101 is not rotated. When a pulse sensor 104 positioned close to aligning rollers pair 101 detects presence of sheet 95, aligning rollers pair 101 begins to rotate. The front edge of sheet 95 is clamped by aligning rollers 101, and sheet 95 is fed to photosensitive drum 53. A developed image on drum 3 is transferred onto sheet 95 by transfer charger 83 as drum 53 rotates. After the transfer process, sheet 95 is conveyed to a fixing device 103 by a conveying belt 105. Then, sheet 95 is further conveyed to a pair of discharge rollers 107, and is discharged to a tray 109.

The discharge completion of sheet 95 is detected by a discharge detection sensor 111 disposed close to discharge rollers pair 107.

Figure 4:
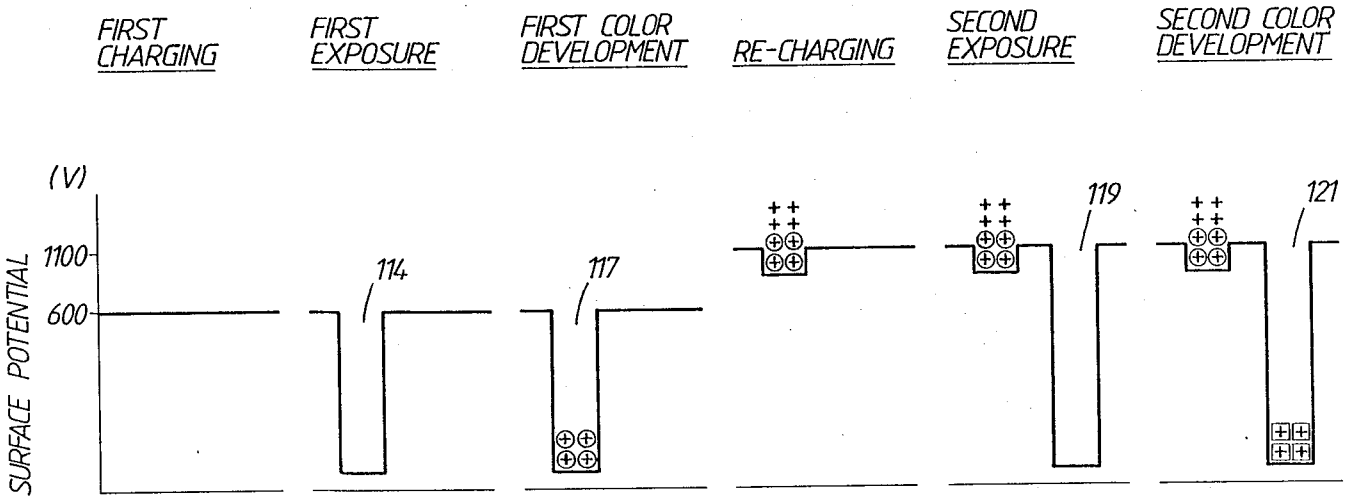
FIG. 4 is a transitional schematic view of the image forming processes of the image forming apparatus shown in FIG. 3.

The two-color image print operation of the two-color image LBP is described hereafter with reference to FIGS. 3 and 4.

When the operation begins, each device and unit are energized. The surface of drum 53 is positively charged by first charger 61 (First charging) to a prescribed level, e.g. 600 volt, as shown in FIG. 4, and the charged surface potential level thereof is detected by first electrical potential sensor 63. First laser beam 69 from one laser diode (not shown) is reflected by polygon-scanning unit 91, and is directed to the surface of drum 53. Therefore, the surface of drum 53 is illuminated by first laser beam 69 in accordance with the image data from a host system (not shown). As a result, a first eleotrostatic latent image 114 is formed on the surface of drum 53 (First exposure), as shown in FIG. 4. The first electrostatic latent image is developed by a developing roller 115 on which the first color developing agent is coated. Developing roller 115 rotates such that the relative velocity between roller 115 and drum 53 is substantially zero. Developing roller 115 is separated from drum 53 at a prescribed gap. When a developing bias is applied to developing roller 115, the first color developing agent on developing roller 115 is transferred to the electrostatic latent image on drum 53 due to the potential difference between developing roller 115 and the electrostatic latent image, as shown in FIG. 4. Thus, a first color image 117 is formed on drum 53 (First color development). The gap between developing roller 115 and drum 53 is determined in accordance with a type of the bias power supply selected from DC voltage supply and a superposed voltage supply wherein AC voltage is superposed on DC voltage.

In this embodiment, the gap between drum 53 and developing roller 115 of first developer 67 which uses the superposed voltage supply is set at 250 μm. In second developer 75 using DC voltage supply, the gap between drum 53 and a developing roller 118 is set at 150 μm.

As shown in FIG. 4, after forming the first color image on drum 53, the surface of drum 53 is recharged by second charger 71 (Re-charging). A non-image formed area of drum 53 is recharged at approximately 1000 V, and the first color image on drum 53 also is charged at approximately 950 V. The recharged voltage level of drum 53 is detected by second electrical potential sensor 73. Second laser beam 77 generated by the other laser diode (not shown) is reflected by polygon-scanning unit 91, and is directed to drum 53. The surface of drum 53 is illuminated by second laser beam 77 in accordance with the image data from the host system. As shown in FIG. 4, a second electrostatic latent image 119 is formed on the surface of drum 53 (Second exposure). Second electrostatic latent image 119 is developed by developing roller 118 on which the second color developing agent is coated. Therefore, a second color image 121 is formed on drum 53 (Second color development), as shown in FIG. 4. The positively charged second color developing agent is transferred to only second latent image. This is because the voltage level of the second latent image is much lower than that of the first color image. The electric charge quantities of the first and second color images 117 and 121 are equalized by pre-transfer charger 79, if necessary.

At this time, recording sheet 95 is taken out from upper cassette 95 by paper-feed roller 99, and is conveyed to drum 53 through aligning roller 101. First and second color images 117 and 121 on drum 53 are transferred onto recording sheet 95. Then, recording sheet 95 is discharged to tray 109 by discharge rollers 95 through fixing device 103.

The inventors carried out some experiments wherein a single-color image print was made by the above-described two-color image LBP.

In the single-color image print, when the deterioration of a photosensitive drum and the extra power consumption of the apparatus are considered, it is desirable to carry out the single-color image print without energizing the second charger and the second developer. However, if the second charger and the second developer are not energized in making a single-color image print, high quality printing may not be obtained. This is because a charging condition and a transfer condition are different between the single-color image print and the two-color image print. Individual print control operations are needed for the single-color image print and for the two-color image print.

Figure 5:
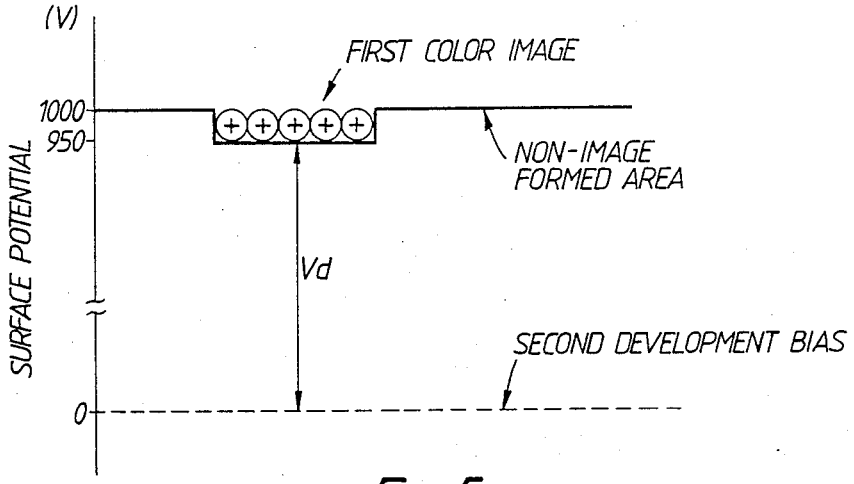
FIG. 5 is a diagram illustrating the potential difference between the surface of an image carrier and a second charger in one experiment.

A first experiment of single-color image print was carried out by the two-color image LBP in accordance with the above-described circumstances. In the first experiment, the second charger was energized in the two-color image LBP to accord the transfer condition between the single-color image print and the two-color image print. However, undesirable phenomenon described below occurred in the first experiment. As stated before, the electrostatic latent image formed on drum 53 is developed by first developer 67. The first color developing agent is transferred to the latent image on drum 53, thus the first color image is formed on drum 53, as shown in FIG. 4. After the first developing process, the surface of drum 53 with the first color image thereon is re-energized by second charger 71. In the first experiment, the first color developing agent of the first color image was transferred to second developer 75 when the first color image on drum 53 reached to second developer 75. This is because a developing bias was not applied to second developer 75, and a large electric voltage difference Vd existed between the first color image on drum 53 and second developer 75, as shown in FIG. 5. As a result, the second color developing agent of second developer 75 was contaminated by the first color developing agent from the first color image on drum 53, and the image density of the first color image was reduced. In particular, when the first color developing agent was a black toner, the second color developing agent was extremely degraded and the life thereof was shortened.

Figure 6:
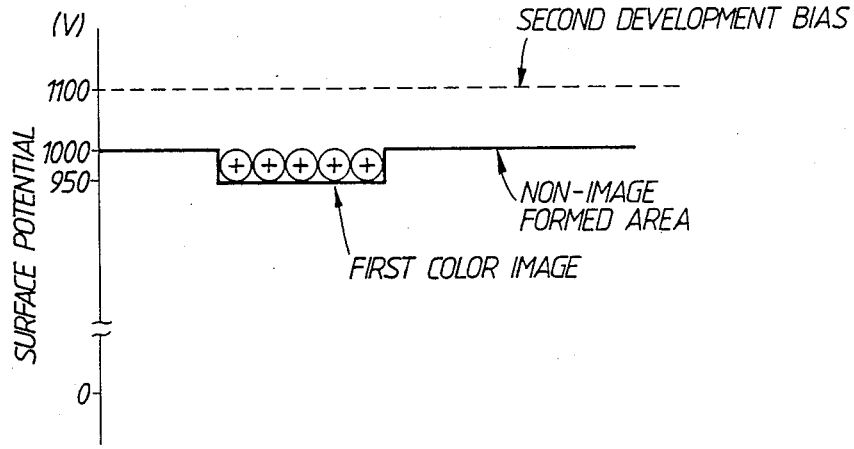
FIG. 6 is a diagram illustrating the potential difference between the surface of the image carrier and the second charger in the other experiment.

To avoid the contamination of the second color developing agent described above, an approximately 1100 V developing bias was applied to the second developer in a second experiment. In the second experiment, the first color image on drum 53 was recharged to a prescribed level (950 V), and the non-image formed area also was recharged to a prescribed level (1000 V) by second charger 71, as stated before. When the first color image on drum 53 passed by second developer 75, no migration of the first color developing agent from the first color image on drum 53 to second developer 75 occurred. This is because the voltage difference between the first color image on drum 53 and the second color developer was small, as shown in FIG. 6. As a result, no contamination of the second color developing agent occurred, and high image density of the first color image was achieved. At this time, since an electrostatic latent image was not formed by the second laser beam because of no second color image signal from the host system, the developing process by the second developer was not carried out even if the developing bias was applied to the second developer.

With the embodiment described above, since the developing bias is applied to the second developer when a single-color image print with the first color developing agent is executed by the two-color image LBP, the transfer of the first color developing agent of the first color image on the drum may be prevented, and the life of the second color developing agent in the second developer can be extended. Furthermore, the degradation of the image density of the first color image may be prevented.

When the present invention is applied to a single color printer wherein two sets of an image formation unit are used, and an image (e.g. Character) from a first host system and an image (e.g. Figure) from a second host system are combined with one the other on the image carrier through each image formation unit, the degradation of the image density of the first image or previous image may be prevented.

The present invention has been described with respect to a specific embodiment. However, many changes and modifications can be carried out without departing from the scope of the present invention. For example, more than two sets of an image formation unit including a charging device, an illuminating element and a developing device may be used. Furthermore, a LED array or a switching element may be used, as an illuminating element, instead of a laser beam. A developing bias applied to a developing device may be changed in accordance with characters of a developing agent and an image carrier (photosensitive drum). Therefore, such embodiments are intended to be covered by the claims.

What is claimed is:

1. An image forming apparatus for forming both single and multi-colored images on an image carrier in response to color image signals, the image forming apparatus comprising:

first image forming means responsive to a first color image signal and including a first developer for forming the first color image on the image carrier, the first color image having a prescribed potential level;

second image forming means responsive to a second color image signal and including a second developer for forming the second color image on the image carrier; and control means for applying a bias voltage to the second developer for reducing the difference in potential level between the first color image and the second developer when only the first color image signal is received by the apparatus.

2. An apparatus according to claim 1, wherein the image carrier has a surface, and the first image forming means includes first charging means for charging the surface of the image carrier to a predetermined surface potential value.

3. An apparatus according to claim 2, wherein the first image forming means further includes first image formation means for forming a first electrostatic latent image in the surface of the image carrier in accordance with the first color image signal.

4. An apparatus according to claim 3, wherein the second image forming means includes recharging means for recharging the surface of the image carrier to a preset surface potential value after first color image is formed.

5. An apparatus according to claim 4, wherein the second image forming means further includes second image formation means for forming a second electrostatic latent image on the surface of the image carrier in accordance with the second color image signal.

6. An apparatus according to claim 2 further including first sensor means for detecting the charged surface potential value of the surface of the image carrier.

7. An apparatus according to claim 4 further including second sensor means for detecting the recharged surface potential value of the surface of the image carrier.

8. An apparatus according to claim 4, wherein the control means includes means for energizing the first image forming means and the recharging means of the second image forming means when only the first color image signal is recevied by the apparatus.

9. An apparatus according to claim 1 further including polygonal scanning unit means for forming one of first and second electrostatic latent images on the surface of the image carrier in response to receipt of one of the first and second color image signals by the apparatus.

10. An apparatus according to claim 9, wherein the polygonal scanning unit means includes at least two laser diodes for generating laser beams for individually illuminating the surface of the image carrier in response to a corresponding one of the first and second color image signals.

11. A method for forming a single color image from a multi-color image forming apparatus having an image carrier, at least first developer including a first color developing agent and second developer including a second color developing agent, comprising the steps of:

charging the image carrier with a predetermined surface potential;

forming a single color image on the charged image carrier by the first color developing agent of the first developer;

recharging the image carrier, the single color image having a prescribed surface potential level; and applying a bias voltage to the second developer for reducing the difference in potential level between the single color image and the second developer and avoiding contamination of the second color developing agent of the second developer by the first color developing agent from the single color image.

12. A method according to claim 11, wherein the bias voltage applied to the second developer is greater than the prescribed surface potential level of the single color image.

13. A method according to claim 11, wherein the prescribed surface potential level is approximately 950 V, and the bias voltage is approximately 1100 V.

14. A method according to claim 11, wherein the forming step includes creating an electrostatic latent image, corresponding to the single color image, on the charged image carrier.

15. A method according to claim 14, further comprising the steps of:

transferring the single color image to a recording medium.

removing the residual first color developing agent on the image carrier.

erasing the electostatic latent image on the image carrier.

16. An image forming apparatus for forming both single image and multi images on an image carrier in response to image signals, the image forming apparatus comprising:

first image forming means responsive to a first image signal and including a first developer for forming the first image of the image carrier, the first image having a prescribed potential level;

second image forming means responsive to a second image signal and including a second developer for forming the second image on the image carrier; and control means for applying a bias voltage to the second developer for reducing the difference in potential level between the first image and the second developer in order to avoid the degradation of the image density of the first image when only the first image signal is received by the apparatus.

* * * * *